United States Patent [19]

Sussman

[11] Patent Number: 5,067,666

[45] Date of Patent: Nov. 26, 1991

[54] PORTABLE PILL CRUSHER

[76] Inventor: David P. Sussman, 7356 E. Pheasant Run, Scottsdale, Ariz. 85258

[21] Appl. No.: 637,181

[22] Filed: Jan. 3, 1991

[51] Int. Cl.[5] ..... B02C 1/00

[52] U.S. Cl. ..... 241/36; 241/100; 241/169.2; 241/DIG. 27

[58] Field of Search ..... 241/DIG. 27, 100, 36, 241/169, 169.2, 199.11

[56] References Cited

U.S. PATENT DOCUMENTS

| | | | |
|---|---|---|---|
| 3,589,626 | 6/1971 | Saurer | 241/100 |
| 3,987,972 | 10/1976 | Gladwin | 241/100 X |
| 4,269,364 | 5/1981 | Moriconi et al. | 241/100 X |
| 4,366,930 | 1/1983 | Trombetti | 241/169 |
| 4,869,435 | 9/1989 | Pistorius et al. | 241/100 |
| 4,967,971 | 11/1990 | Smith | 241/169 |

FOREIGN PATENT DOCUMENTS

| | | | |
|---|---|---|---|
| 0727229 | 4/1980 | U.S.S.R. | 241/DIG. 27 |

*Primary Examiner*—Mark Rosenbaum
*Attorney, Agent, or Firm*—Richard R. Mybeck

[57] ABSTRACT

A portable device for pulverizing pills, tablets and the like to form a minute substantially uniform powder therefrom. The device includes a cam-driven spring biased ram which reciprocates once on a vertical axis into and out of engagement with a pill disposed therebeneath with sufficient localized force to pulverize the pill. A microswitch interrupts power to the device until it senses that the pill is correctly disposed axially beneath the ram.

8 Claims, 1 Drawing Sheet

PORTABLE PILL CRUSHER

INTRODUCTION

The present invention relates generally to a portable pill crusher and more particularly to a battery-operated, cam driven, reciprocating ram, pulverizing device which is especially useful for crushing small objects, especially medicaments and nutriments delivered as tablets and pills.

BACKGROUND OF THE INVENTION

Some patients can not swallow or have difficulty swallowing standard oral nutriments and medications. For example, many geriatrics have difficulty swallowing tablets. Furthermore, patients who must ingest nutrients through oral feeding tubes can not swallow individual medication dosages formed as pills and tablets. An historical solution for these persons has been the use of a traditional mortar and pestle to manually crush the pill or tablet into a fine powder which is then stored in a medicine cup until it is administered to the patient.

The mortar and pestle, however, has certain problems inherent with its use. First, the mortar and pestle must be thoroughly cleaned after each use to prevent the matter with which it is next used from becoming contaminated with the residue from the last substance with which it was used. Secondly, crushed powder adhering to the mortar or the pestle can reduce the ultimate dosage transferred to the patient resulting in sub-standard treatment. Third, the mortar and pestle is operated manually by each care provider which causes inconsistent results in the particle size of the crushed tablets and pills and can result in a portion of the dose to be lost when incorrect pressure is applied at an angle which permits some of the material to exit the mortar.

Attempts by the prior art to overcome these problems include both manual and motor driven devices which were specifically designed to cut, crack or pulverize small objects including food, nuts and medicinal tablets. Some such devices are disclosed in U.S. Pat. Nos. 1,940,327 (Rosenthal); 2,656,866 (Rumsey); 4,121,775 (Rosenberg et al); 4,209,136 (Linden et al); and 4,366,930 (Trombetti Jr) which include both manual and motor driven means for crushing tablets. However, none of the prior art devices provide either the convenience or the integrity required to accommodate the needs of the home bound geriatric or of those required to depend on enteral feeding systems for sustenance. It is toward the realization of these later goals that the present invention is directed.

BRIEF DESCRIPTION OF THE INVENTION

The present invention comprises a portable battery operated device for pulverizing pills and tablets to form a minute substantially uniform powder which is more readily ingested by those persons who encounter difficulty in swallowing medications and/or nutriments presented in the forms of tablets or pills.

More particularly, the device hereof comprises a cam-driven ram which reciprocates once on a vertical axis into and out of engagement with a pill or tablet disposed in a medicant cup and positioned therebeneath with sufficient force to "smash" the tablet or pill. After "smashing" the pill/tablet, the ram is returned to its uppermost position by the coaction of an eccentric cam associated at the upper end thereof and of compression spring operatively circumscribed thereabout.

Accordingly, a principal object of the present invention is to provide a new and improved portable pill crusher which is quick, portable, easy to use and is capable of pulverizing tablets and pills containing medicament and/or nutriments into a minute substantially uniformly sized powder which can be readily ingested by geriatric patients and those equipped with an enteral feeding system.

Another object of the present invention is to provide a portable pulverizer for comminuting tablets and pills into a fine powder without losing any of the precalculated material.

These and still further objects as shall hereinafter appear are readily fulfilled by the present invention in a remarkably unexpected manner as will be readily discerned from the following detailed description of an exemplary embodiment thereof especially when read in conjunction with the accompanying drawing in which like parts bear like numerals throughout the several views.

DESCRIPTION OF THE PREFERRED EMBODIMENT

Figure 1:
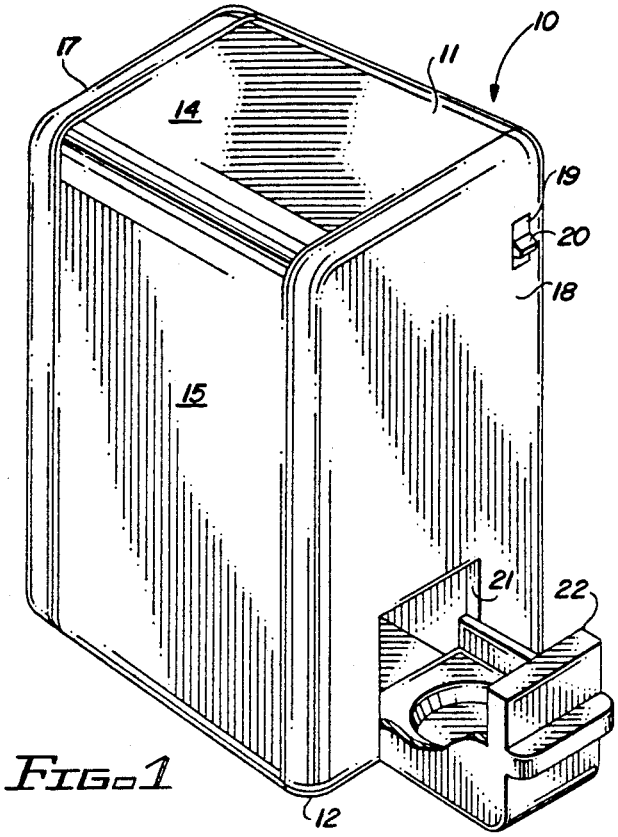
FIG. 1 is an isometric elevation of a portable pill crusher embodying view of the present invention.

Referring to the drawing, a portable pill crusher embodying the present invention is identified by the general reference 10. Device 10 comprises an upstanding rectangular housing 11 including detachable base plate 12 having a plurality of foot pads 13 depending therefrom suitable to support device 10 on a suitable horizontal surface, such as a counter, a table top and the like.

Housing 11 further comprises a top 14, generally parallel sides 15, 16, a rear plate 17 and a front plate 18. Frontal plate is provided with a first rectangular opening 19 in which a suitable switch 20 is mounted and a second rectangular opening 21 of sufficient dimensions to receive drawer 22 for sliding movement therein as will hereinafter be described in more detail.

The operating mechanisms of device 10 are essentially mounted within housing 11 and will now be described.

In a preferred embodiment of device 10, device 10 is totally portable and self powered by a 12 v nickel cadmium battery pack 24 mounted on upper surface 25 of base plate 12. NiCad batteries are preferred because they are rechargeable, long lasting and are capable of producing a consistent voltage at a high current rate for longer periods than other battery types currently available. A conventional battery charger 26 is also mounted on base plate 12 adjacent battery pack 24 and connected thereto to conveniently maintain fully charged batteries in device 10 without having to remove battery pack 24. Battery pack 24 and battery charger 26 also contribute to the stability of device 10 during operation as their weight and lower center of gravity serves to offset the forces generated by the movement of ram 28 as will hereinafter appear.

Figure 4:
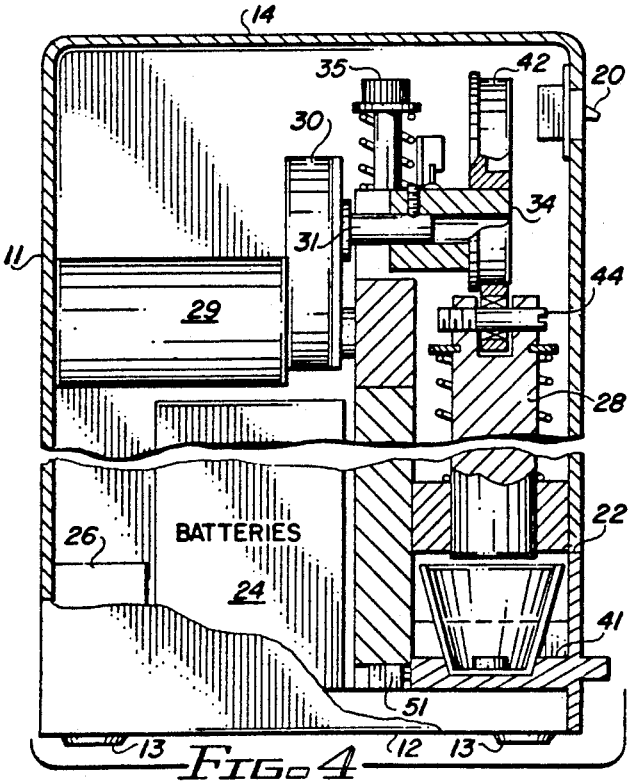
FIG. 4 is a rear view, with the housing removed of a device embodying the present invention.

Ram 28 is preferably powered by 12 v DC electric motor 29 mounted in housing 11 above battery pack 24 and the drive of electric motor 29 is transmitted into gearcase 30 to produce a constant 200 RPM output to cam drive shaft 31. Gearmotor mounting plate 32 which is connected to support plate 33 in turn is mounted on base plate 12 and extends upwardly therefrom supports both motor 29 and gearcase 30. Drive shaft 31 is secured by a shoulder mount 34. Additional flexibility which protects the shaft from undo stress during operation is provided by two shoulder bolts 35 which secure the shoulder mount 34 over the shaft 31 as shown in FIG. 4. Bolts 35 fit into the gearmotor mounting plate 32. Tension applied to cam drive 31 is controlled by washer 36 and die spring 37 which circumscribes each shoulder bolt 35.

In operation, ram 28 will move up and down very rapidly into and out of the medicine cup 40 which contains the pill or table to be crushed. Medicine cup 40 is seated in a suitable defined recess 41 defined in drawer 22.

Figure 2:
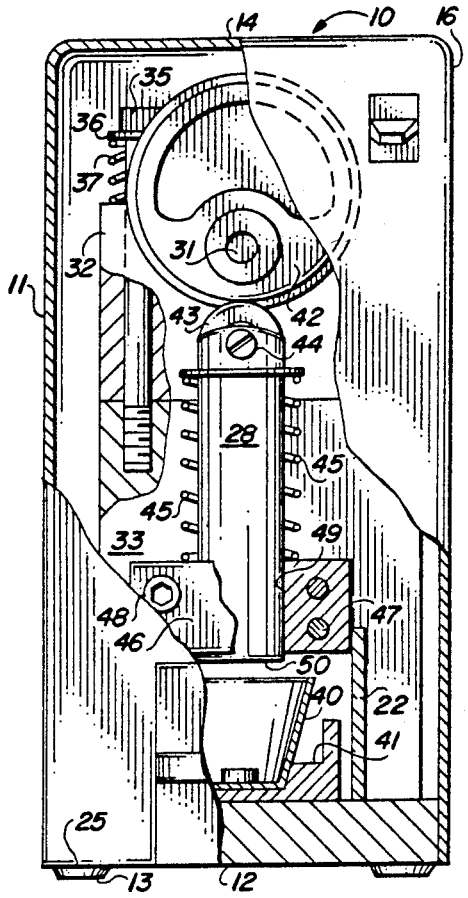
FIG. 2 is an side elevation, partially in cross section, of the device of FIG. 1.
Figure 3:
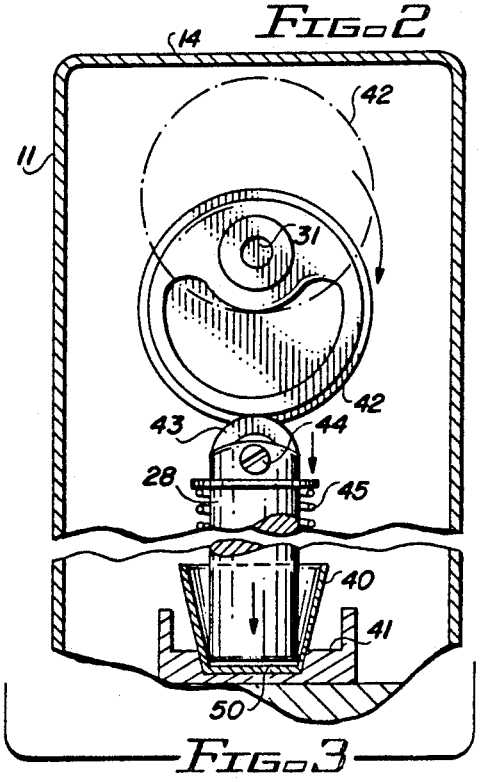
FIG. 3 is a cut-away front view of device of FIG. 2.

An eccentric cam 42, preferably made of steel, is mounted on the end of cam drive shaft 31 and as it rotates, engages and depresses ram 28. As is apparent from FIGS. 2 and 3, cam 42 is so mounted on drive shaft 31 to create an eccentric perimeter path in response to the rotation of the cam shaft 31. Cam 42 rides on a ball bearing 43 mounted on a bearing shaft 44 adjacent the top of ram 28 which alleviates friction and allows cam 42 to turn smoothly as it depresses ram 28. A return spring 45 disposed in circumscription about ram 28, causes ram 28 to raise out of drawer 22 when cam 42 reaches its minimum position, that is, when the least mass is disposed between shaft 31 and ram 28.

A cylindrical guide block 46 is mounted with dowel pins 47 and secured with a socket head cap screw 48 to the support plate 33. Block 46 mounted slightly above the top of the drawer 22 which is configured to contain medicine cup 40 therein which in turn holds the item to be pulverized. In the center of guide block 46 is an opening having an inside diameter just sufficient to allow ram 28 to reciprocate freely through it.

When ram 28 is in its uppermost position, the bottom 50 of ram 28 will extend just below guide block 46. Because of the tight fit between ram 28 and guide shaft 49 of guide block 46, contamination of the inner workings of the unit by pulverized particles is prevented.

Microswitch 51, is mounted within housing 11 and is employed in the operation of device 10 and senses when drawer 22 is closed. Until switch 51 senses that drawer 22 is closed, the power to motor 29 is interrupted and device 10 will not operate. This safeguard prevents such serious occurences as damage to the unit and possible loss of pulverized particles.

Pulverization of a pill, tablet, or similar small object takes place in the following manner:

The object to be crushed is placed within a medicant cup 40. The medicant cup 40 is then seated within drawer 22 and drawer 22 is closed by sliding it through opening 21 and into the body of device 10. Microswitch 51 senses when drawer 22 is completely closed and will prevent delivery of power to device 10 until drawer 22 is properly closed.

After drawer 22 is closed, the operation switch 20 is pressed to activate the mechanism and held while motor 29 operating through gearcase 30 causes the cam 42 to rotate and press ram 28 down within its guide block 46 into the medicant cup 40 and into crushing contact with the medicament disposed therein causing the medicine to be broken and pulverized into a fine powder. The depression of switch 20 causes the motor 29 to continue rotating cam 42 until largest mass of cam 42 returns to its uppermost position whereupon switch 20 is released and ram 28 recoils in response to compression spring 45 which circumscribes ram 28 and causes the ram 28 to move upwardly out of the medicant cup 40 and container drawer 22 when the counter force of cam 42 is removed from the upper end of ram 28.

The container drawer 22 is now opened and the medicant cup 40 containing the pulverized medication or nutriment is removed and the powder thus formed delivered to the user in the appropriate fashion. Clean up involves simply wiping the lower end 50 of ram 28 with an alcohol soaked swab or the like to remove any powder remaining thereon.

From the foregoin, it becomes apparent that new and useful device has been herein described and illustrated which fulfills all of the aforestated objectives in a remarkable unexpected fashion. It is of course understood that such modification, alterations and adaptations as may readily occur to an artisan having the ordinary skills in the art to which this invention pertains are intended within the spirit of the present invention which is limited solely by the scope of claims appended hereto.

Accordingly what is claimed is:

1. A portable pill crusher comprising in combination: a housing; a pill receptacle moveable into and out of said housing and adapted to secure a pill therewithin; a pill disposed in said container; motor means operatively mounted in said housing and selectively activatable to produce a power output; cam means mounted in said housing to enable the perimeter thereof to provide an eccentric path of rotation, ram means being operatively associated with said cam means and reactive to said perimetric path of eccentric rotation of said cam means to reciprocate within said housing into and out of said receptacle disposed axially therebeneath; and spring means circumscribing said ram means to constantly urge said ram means in an upward direction and, when said cam means disengages said ram means, force said ram means into its uppermost position.

2. A portable pill crusher according to claim 1 in which said pill receptacle contains a medicant cup for receiving and maintaining said powder.

3. A portable pill crusher according to claim 1 in which said motor means comprises an electric motor; a source of electric power operatively connected to said electric motor and selectively actuable to operate said motor; a cylindrical cam drive shaft having a first end and a second end, said first end being connected to said motor and said second end being secured to said cam means and rotatable in response to the rotation of said motor.

4. A portable pill crusher according to claim 3 in which said source of electric power comprises a rechargeable battery pack.

5. A portable pill crusher according to claim 4 having a battery charger operatively associated with said battery pack and selectively operatable to recharge said battery pack to its rated voltage.

6. A portable pill crusher according to claim 3 having a microswitch operatively interposed between said motor means and said source of electric power to interrupt the transmission of power between said electric motor and said power source until said pill receptacle is moved completely into said housing.

7. A portable pill crusher according to claim 6 in which said source of electric power comprises a rechargeable battery pack.

8. A portable pill crusher according to claim 7 having a battery charger operatively associated with said battery pack and selectively operatable to recharge said battery pack to its rated voltage.

* * * * *